United States Patent [19]

Smith

[11] 4,347,728

[45] Sep. 7, 1982

[54] APPARATUS AND SYSTEM FOR SETTING FASTENERS

[75] Inventor: Walter J. Smith, Waco, Tex.

[73] Assignee: Huck Manufacturing Company, Irvine, Calif.

[21] Appl. No.: 195,627

[22] Filed: Oct. 9, 1980

Related U.S. Application Data

[63] Continuation of Ser. No. 43,742, May 30, 1979, abandoned, which is a continuation-in-part of Ser. No. 899,591, Apr. 24, 1978, Pat. No. 4,208,943.

[51] Int. Cl.[3] ..... B21J 15/34

[52] U.S. Cl. ..... 72/391

[58] Field of Search ..... 72/391, 453.05, 453.17; 411/361, 337, 34, 41, 43, 70

[56] References Cited

U.S. PATENT DOCUMENTS

| | | | |
|---|---|---|---|
| 2,132,112 | 10/1938 | Huck | 72/381 |
| 2,527,307 | 10/1950 | Huck | 72/367 |
| 2,531,048 | 11/1950 | Huck | 411/361 |
| 2,972,274 | 2/1961 | Bombard et al. | 411/377 |
| 2,978,946 | 4/1961 | Looker | 411/361 |
| 3,107,806 | 10/1963 | Van Hecke et al. | 72/391 |
| 3,192,821 | 7/1965 | Siebol | 411/41 |
| 3,230,818 | 1/1966 | Siebol | 411/34 |
| 3,232,162 | 2/1966 | Ketchum | 411/70 |
| 3,276,308 | 10/1966 | Bergere | 411/43 |
| 3,309,911 | 3/1967 | Simmons | 72/453.17 |
| 3,406,557 | 10/1968 | Harris | 72/391 |
| 3,457,763 | 7/1969 | Freeman | 72/453.17 |
| 3,792,933 | 2/1974 | Stencel | 72/391 |
| 3,915,053 | 10/1975 | Ruhl | 411/361 |
| 4,208,943 | 6/1980 | Smith | 72/391 |

FOREIGN PATENT DOCUMENTS

| | | |
|---|---|---|
| 550230 | 12/1942 | United Kingdom . |
| 555533 | 8/1943 | United Kingdom . |
| 602853 | 6/1948 | United Kingdom . |
| 1188935 | 4/1970 | United Kingdom . |

OTHER PUBLICATIONS

Huck Manufacturing Company Nose Assembly Data Sheet, No. 99-748, and No. 99-1050

*Primary Examiner*—Gene Crosby

*Attorney, Agent, or Firm*—Harness, Dickey & Pierce

[57] ABSTRACT

A tool for setting fasteners in which the fasteners comprise a pin member each having a plurality of grooves adapted to be gripped by a plurality of jaws in a nose assembly of the tool with the jaws being connected to a resilient member in a manner maintaining the jaws in a desired axial and radial alignment with each other and with the tool and selected fasteners defining a fastening system.

18 Claims, 4 Drawing Figures

10
12
14
16
18
20
22
24
26
27
28
30
32
34
36
38
40
42
44
46
48
50
52
D
D1
P
4
4

APPARATUS AND SYSTEM FOR SETTING FASTENERS

This is a continuation of application Ser. No. 043,742, filed May 30, 1979, now abandoned , which is a continuation-in-part of my copending patent application Ser. No. 899,591, filed Apr. 24, 1978 and which issued into U.S. Pat. No. 4,208,943 on June 24, 1980.

SUMMARY BACKGROUND OF THE INVENTION

The present invention relates to tools for setting fasteners having pin members with pull grooves and more particularly to tools having a plurality of jaws for gripping the pull grooves.

In the setting of multi-pieced fasteners generally of types such as those shown in the U.S. Pat. Nos. 2,527,307 and 2,531,048 issued to L. C. Huck on Oct. 24, 1950 and Nov. 21, 1950, respectively, it has been the practice to utilize a tool having a plurality of generally independently movable chuck jaws. The latter are generally shown in the above noted patents to L. C. Huck and the details of the same are exemplified in the U.S. Pat. No. 3,107,806 issued Oct. 22, 1963 to G. J. Van Hecke et al.

With such jaw structures it is possible under certain conditions of pin insertion to move the jaws out of axial alignment. When this occurs and the tool is actuated, the pin is gripped by less than the full complement of jaws; this can lead to stripping of the jaw teeth, stripping of the pull grooves and/or ultimate failure of one or more jaws.

In addition such jaw structures are normally held closed by a spring biased jaw follower assembly. Thus, in order to insert the pin into the jaws the spring bias load must be overcome as the jaws are moved axially rearwardly and radially outwardly. In some assembly operations such insertion loads can be undesirably high.

For example, the insertion load magnitude appears to be aggravated by fasteners in which the grooves to be gripped on the pin are relatively deep. Such a fastener structure is shown and described in copending patent application Ser. No. 899,591, filed Apr. 24, 1978 and which issued into U.S. Pat. No. 4,208,943 on June 24, 1980; the disclosure of the latter patent application is fully incorporated herein by reference. With such fasteners it is possible for one of the jaws to be permanently moved from its proper position requiring the tool to be disassembled and the jaw properly positioned again. In addition, occasionally with the latter type fastener, pin break may occur across more than one groove resulting in relatively small sized debris being carried into the tool. With conventional tool structures, the large number of relatively independently movable parts provides an environment in which the debris may lodge and eventually jam the tool or seriously impair its operation. As shown in the above noted copending application the fastener includes a pin member having a plurality of grooves and associated crests; these grooves and crests are substantially identical annular combination locking and breakneck grooves defined by cooperating side walls which converge into a selected concave radius portion. This concave radius portion is of a magnitude selected to provide a predetermined stress concentration to facilitate fracture at a selected one of the grooves proximate the outer end of an associated collar.

In the present invention the jaws, which are conventionally constructed of hardened steel, are secured to an elastomeric structure such that the axial misalignment is substantially precluded. At the same time the jaws are held in a preselected open position whereby insertion loads are minimized. Since the number of parts is substantially reduced the likelihood of the tool jamming from debris is minimized.

Thus the tool and the noted fastener cooperate to provide a novel fastening system. It should be noted, however, that the tool can be utilized with fasteners of a different construction.

Other objects, features, and advantages of the present invention will become apparent from the subsequent description and the appended claims, taken in conjunction with the accompanying drawing, in which:

Figures 1, 2, 3, 4:
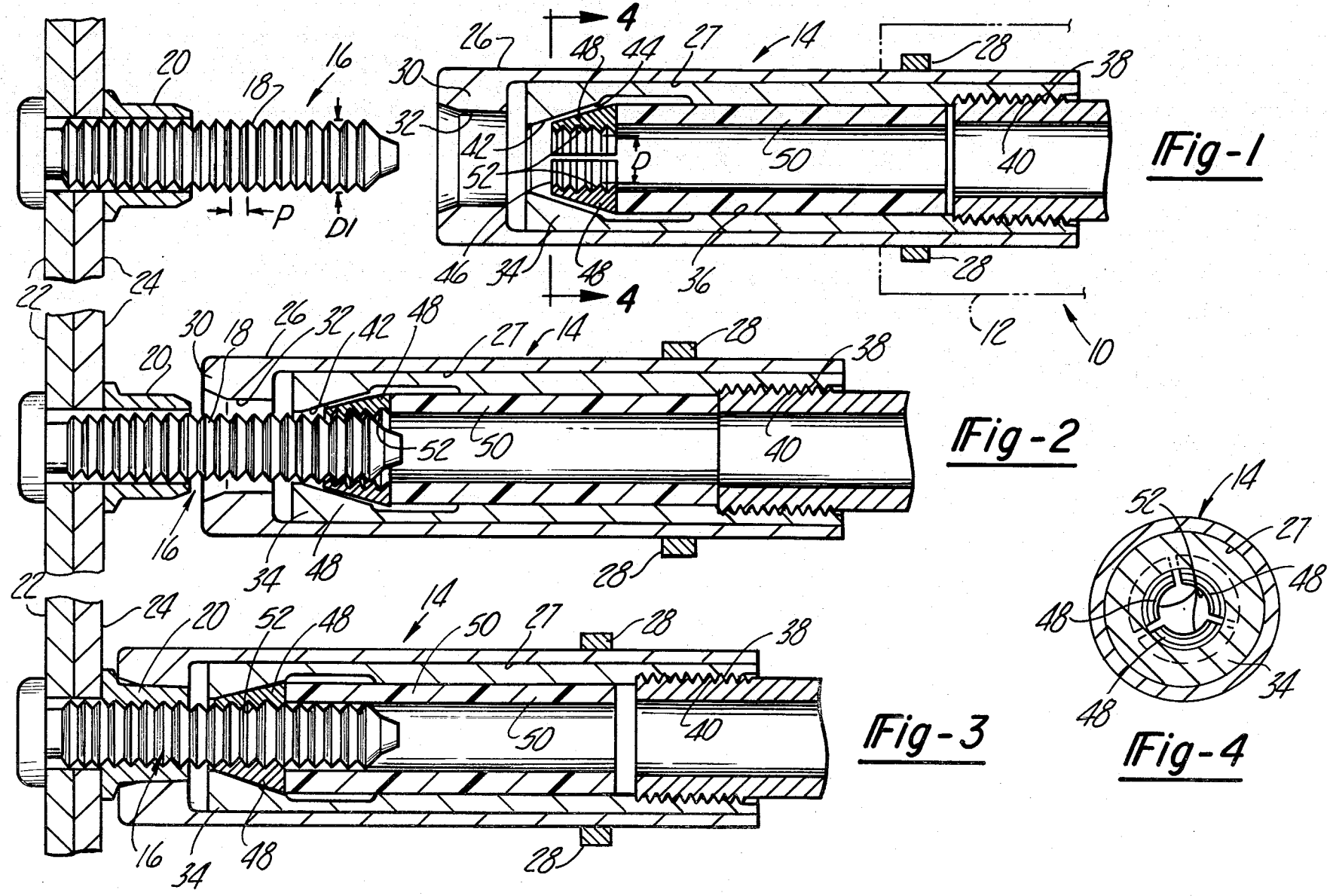
FIG. 1 is a longitudinal view with some parts shown in section of a tool and fastener of the present invention prior to application of the tool to the fastener.
FIG. 2 is a similar longitudinal view showing the tool applied to the fastener but prior to actuation of the tool.
FIG. 3 is a similar longitudinal view showing the tool and fastener with the tool having been actuated and in its second pull stroke and with fastener having been substantially set.
FIG. 4 is a sectional view of the tool of FIG. 1 taken generally along the line 4—4 of FIG. 1.

Looking now to the drawings, a pull gun assembly is generally indicated by the numeral 10 and comprises a pull gun member 12 (partially shown in phantom lines) which is operable with a nose assembly 14 for setting a fastener 16. The fastener 16, includes a pin member 18 and a collar 20, adapted to be swaged thereon, with the pin 18 being disposed in aligned bores in a pair of workpieces 22 and 24. The pull gun member 12 can be of a conventional type capable of applying a relative axial force such as that described in the patent to L. C. Huck, U.S. Pat. No. 2,132,112.

The nose assembly 14 comprises a generally tubular outer anvil member 26 having an axial bore 27 and having radially extending ears or lugs 28 proximate one end for locking engagement with the receiving end of the casing of the gun member 12 by means known to the art. In this regard the ears or lugs 28 could be provided by a separate ring and groove combination.

The opposite end of the outer anvil member 26 is substantially closed by an anvil portion 30 having a swaging bore 32 located therein. Note that in some constructions a separate anvil portion could be utilized (as shown in the noted copending patent application). The swaging bore 32 can have a variety of shapes selected to facilitate swaging.

Slidably disposed within the outer anvil member 26 is generally tubular collet member 34 which has an axial bore 36 which is internally threaded at its rearward portion 38. This rearward portion 38 is threadably engaged with a threaded portion 40 of a piston rod (partially shown) of the pull gun member 12. The forward end of the collet member 34 has an axially outwardly radially inwardly tapered bore 42 which terminates at its enlarged end in an increased diameter bore portion 44.

A unitized jaw assembly and follower 46 is slidably disposed within the collet member 34 and comprises a plurality of jaw members 48 secured at their rearward ends to the leading surface of a generally tubular elastomeric sleeve member 50. The outer surfaces of the jaw members 48 define a frusto conically inclined surface which is matable within the tapered bore 42.

In one form of the invention the elastomeric member 50 can be of a flexible urethane construction. The jaw members 48 (which in one form are three in number) can be bonded to the sleeve member 50 as a separate step or can be bonded simultaneously with the forming of the elastomeric member 50 where a urethane construction is used. The rearward ends of the jaw members 48 can be notched, grooved or serrated to increase the surface area and to thereby enhance the bond with the sleeve member 50. Thus the jaw members 48 are flexibly secured to the resilient sleeve member 50 and as secured can resiliently move radially. Note that since the member 50 is elastomeric the jaw members 48 can, to a degree, move resiliently axially.

The jaw members 48 have pluralities of teeth 52 for gripping the grooves of the pin member 18. Note that the teeth 52 are of a shape which are similar to and generally complement the grooves of pin member 18. As secured to the sleeve member 50 the teeth 52 of each of the jaw members 48 are located and held in axial alignment with those of the other jaw members 48. Since relative axial movement between jaw members 48 is inhibited by the sleeve member 50, axial misalignment between teeth 52 is substantially precluded whereby proper engagement of the grooves of the pin 18 by the teeth 52 of all of the jaw members 48 is substantially assured.

It is desirable that the jaw members 48 not be held closed under a high preload. To this end, with the present invention, the jaw members 48 can be located via the flexible connection with the sleeve member 50 such that in their relaxed, non actuated condition the jaw members are generally opened, i.e. radially spaced from each other, whereby the crests of the jaw teeth 52 define an insertion diameter D. The diameter D is slightly less than the crest diameter D1 on the pin member 18 whereby a preselected minimum interference is provided. The magnitude of this interference is selected to provide a minimum insertion force when the pull gun 12 is applied to the pin 18 and at the same time to assure sufficient interference during initial gripping. The initial gripping of the pin member 18 occurs when the pull gun assembly 10 is actuated to move the collet member 34 rearwardly relatively to the outer anvil 26 at which time the tapered bore 42 engages the frusto conical surface of the jaw members 48. The initial gripping or interference must be sufficient to hold the jaw and follower assembly 46 to the grooves of the pin 18 so that the jaws 48 will not slip off the pin 18. Further relative rearward movement of the collet member 34 will cause the jaw members 48 to move forwardly (relatively) into the tapered bore 42 causing the jaw members 48 to attain their fully closed position whereby gripping of the pin 18 is complete. Further movement of the collet 34 and the jaw and follower assembly 46 relative to the outer anvil 26 will result in application of the desired relative axial force between pin 18 and collar 20 and in setting of the fastener 16; if the stroke of the pull gun 12 is insufficient to completely set the fastener 16, its continued actuation will result in a second cycle, i.e. reciprocation of collet 34 and jaw and follower assembly 46 whereby the pin member 18 will be gripped closer to the collar 20. (See FIG. 3). Upon setting of the fastener 16 the pin member 18 will be severed at one of the grooves near the end of the collar 20. The severed portion of the pin member 18 will pass through the pull gun 12 via sleeve member 50 for ejection out the rear of the pull gun 12.

In order to provide minimum insertion loads while still providing sufficient interference for initial gripping it is desirable to have the crest diameter D on the jaws 48 such that at initial gripping the teeth 52 will be located at approximately one half the depth of the grooves of the pin member 18, i.e. the mean diameter between the grooves and the associated crests on the pin member 18 (see FIG. 2).

Note that in the construction of FIGS. 1–3, the jaw and follower assembly 46 is free to float, i.e. move axially, within the collet 34 between the threaded portion 40 of the piston rod and the tapered bore 42. This permits some degree of radially outward movement of the jaw members 48 whereby the pin member 18 can be inserted through the opening (diameter D) with a ratcheting type action. It is preferred, however, that the amount of axial movement of the jaw and follower assembly 46 be limited to no more than around one pitch, P, of the grooves of pin member 18. This limitation on the axial float is provided to minimize the reduction in grip capability of the nose assembly 14, i.e. the minimum length of pin member 18 required to permit gripping by the jaw members 48. The axial float can be minimized where the flexibility of the sleeve member 50 is sufficient to permit the necessary movement of the jaw members 48.

The sleeve member 50 being resilient does permit deflection of the jaw members 48 and also provides a shock absorbing function at pin break. Since the sleeve member 50 extends generally for the length of the collet bore 36 that portion of the pin member 18 severed at pin break and resultant debris carried by the broken pin portion or otherwise located within the sleeve member 50 can be expelled thereby reducing the likelihood of jamming the nose assembly 14.

While it will be apparent that the preferred embodiments of the invention disclosed are well calculated to fulfill the objects above stated, it will be appreciated that the invention is susceptible to modification, variation and change without departing from the proper scope or fair meaning of the invention.

What is claimed is:

1. Apparatus for applying a fastener which includes a pin member having a head and a shank and a plurality of grooves therein and a tubular member adapted to be located over the shank of the pin member and swaged into some of the grooves, said apparatus comprising a generally tubularly shaped anvil member having a swaging aperture through a forward portion thereof for swaging the tubular member to the pin member, a generally tubular collet member slidably located within said anvil member and having an axial bore terminating at its forward end in a tapered bore portion, a plurality of chuck jaws defining a frusto conical outer surface adapted to generally matably fit within said tapered bore portion of said collet and each having an inner surface with a plurality of teeth thereon adapted to grip others of the grooves of the pin member, a tubular sleeve member slidably disposed in said axial bore including elastomeric means for resiliently fixedly securing said chuck jaws to a forward end of said tubular sleeve for resilient, radial movement between open and closed positions.

2. The apparatus of claim 1 with said tubular member being substantially coextensive with said axial bore of said collet member.

3. Apparatus for applying a fastener which includes a pin member having a head and a shank and a plurality of grooves therein and a tubular member adapted to be located over the shank of the pin member and swaged into some of the grooves, said apparatus comprising a generally tubularly shaped anvil member having a swaging aperture through a forward portion thereof for swaging the tubular member to the pin member, a generally tubular collet member slidably located within said anvil member and having an axial bore terminating at its forward end in a tapered bore portion, a plurality of chuck jaws defining a frusto conical outer surface adapted to generally matably fit within said tapered bore portion of said collet and each having an inner surface with a plurality of teeth thereon adapted to grip others of the grooves of the pin member, a tubular sleeve member slidably disposed in said axial bore including elastomeric means for resiliently fixedly securing said chuck jaws to a forward end of said tubular sleeve for resilient, radial and axial movement between open and closed positions, said tubular sleeve and said chuck jaws being free to axially float within said collet bore from a first position in which said jaws are engaged with said tapered bore portion and are radially closed thereby and a second position in which said jaws are disengaged from said tapered bore portion and are in a radially open condition, said jaws as secured to said tubular sleeve normally being held in said open condition.

4. The apparatus of claim 3 with said tubular member being substantially coextensive with said axial bore of said collet member.

5. Apparatus for applying a fastener which includes a pin member having a head and a shank and a plurality of grooves therein and a tubular member adapted to be located over the shank of the pin member and swaged into some of the grooves, said apparatus comprising a generally tubularly shaped anvil member having a swaging aperture through a forward portion thereof for swaging the tubular member to the pin member, a generally tubular collet member slidably located within said anvil member and having an axial bore terminating at its forward end in a tapered bore portion, a plurality of chuck jaws defining a frusto conical outer surface adapted to generally matably fit within said tapered bore portion of said collet and each having an inner surface with a plurality of teeth thereon adapted to grip others of the grooves of the pin member, a tubular sleeve member slidably disposed in said axial bore, said chuck jaws being individually resiliently fixed secured to a forward end of said tubular sleeve, said tubular sleeve and said chuck jaws being free to axially float within said collet bore from a first position in which said jaws are engaged with said tapered bore portion and are radially closed thereby and a second position in which said jaws are in a radially open condition, said jaws as secured to said tubular sleeve normally being held in said open condition.

6. The apparatus of claim 5 with the length of said axial float being approximately the axial distance between adjacent ones of the others of the grooves of the pin member.

7. Apparatus for applying a fastener which includes a pin member having a head and a shank and a plurality of grooves and associated crests therein and a tubular member adapted to be located over the shank of the pin member and swaged into some of the grooves, said apparatus comprising a generally tubularly shaped anvil member having a swaging aperture through a forward portion thereof for swaging the tubular member to the pin member, a generally tubular collet member slidably located within said anvil member and having an axial bore terminating at its forward end in a tapered bore portion, a plurality of chuck jaws defining a frusto conical outer surface adapted to generally matably fit within said tapered bore portion of said collet and each having an inner surface with a plurality of teeth thereon adapted to grip others of the grooves of the pin member, a tubular sleeve member slidably disposed in said axial bore, said chuck jaws being individually resiliently fixed secured to a forward end of said tubular sleeve, said tubular sleeve and said chuck jaws being free to axially float within said collet bore from a first position in which said jaws are engaged with said tapered bore portion and are radially closed thereby and a second position in which said jaws are in a radially open condition, said jaws as secured to said tubular sleeve normally being held in said open condition, said teeth of said jaws having a shape complementary to that of the grooves and crests of the pin member, said jaws in said open condition having said teeth define a minimum diameter opening which is less than the diameter of the crests and greater than that of the grooves whereby the loads required to insert the pin member into said jaws is minimized while providing sufficient interference to preclude said jaws from slipping off the pin member upon relative movement between said collet and said jaws.

8. The apparatus of claim 7 with said minimum diameter being approximately the mean diameter between that of the others of the grooves and their associated crests.

9. The apparatus of claim 7 with said sleeve being constructed of an elastomeric material.

10. A fastening system comprising apparatus for applying a fastener which includes a pin member having a head and a shank and a plurality of grooves and associated crests therein and a tubular member adapted to be located over the shank of the pin member and swaged into some of said grooves, all of said grooves and crests being substantially identical annular combination locking and breakneck grooves defined by cooperating side walls which converge into a selected concave radius portion, said concave radius portion being of a magnitude selected to provide a predetermined stress concentration to facilitate fracture at a selected one of said grooves proximate the outer end of said tubular member; said apparatus comprising a generally tubularly shaped anvil member having a swaging aperture through a forward portion thereof for swaging the tubular member to the pin member, a generally tubular collet member slidably located within said anvil member and having an axial bore terminating at its forward end in a tapered bore portion, a plurality of chuck jaws defining a frusto conical outer surface adapted to generally matably fit within said tapered bore portion of said collet and each having an inner surface with a plurality of teeth thereon adapted to grip others of said grooves of the pin member, a tubular sleeve member slidably disposed in said axial bore, said chuck jaws being individually resiliently fixedly secured to a forward end of said tubular sleeve, said tubular sleeve and said chuck jaws being free to axially float within said collet bore from a first position in which said jaws are engaged with said tapered bore portion and are radially closed thereby and a second position in which said jaws are disengaged from said tapered bore portion and are in a radially open condition, said jaws as secured to said tubular sleeve normally being held in said open condition.

11. A fastening system comprising apparatus for applying a fastener which includes a pin member having a head and a shank and a plurality of grooves and associated crests therein and a tubular member adapted to be located over the shank of the pin member and swaged into some of said grooves, at least a predetermined number of said plurality grooves and crests being substantially identical annular combination locking and breakneck grooves defined by cooperating side walls which converge into a selected concave radius portion, said concave radius portion being of a magnitude selected to provide a predetermined stress concentration to facilitate fracture at a selected one of said grooves proximate the outer end of said tubular member, said apparatus comprising a generally tubularly shaped anvil member having a swaging aperture through a forward portion thereof for swaging the tubular member to the pin member, a generally tubular collet member slidably located within said anvil member and having an axial bore terminating at its forward end in a tapered bore portion, a plurality of chuck jaws defining a frusto conical outer surface adapted to generally matably fit within said tapered bore portion of said collet and each having an inner surface with a plurality of teeth therein adapted to grip others of said grooves of the pin member, a tubular sleeve member slidably disposed in said axial bore, said chuck jaws being individually secured to a forward end of said tubular sleeve, said tubular sleeve and said chuck jaws being free to axially float within said collet bore from a first position in which said jaws are engaged with said tapered bore portion and are radially closed thereby and a second position in which said jaws are disengaged from said tapered bore portion and are in a radially open condition, said jaws as secured to said tubular sleeve normally being held in said open condition.

12. Apparatus for applying a fastener which includes a pin member having a head and a shank and a plurality of grooves therein and a tubular member adapted to be located over the shank of the pin member and swaged into some of the grooves, said apparatus comprising a generally tubularly shaped anvil member having a swaging aperture through a forward portion thereof for swaging the tubular member to the pin member, a generally tubular collet member slidably located within said anvil member and having an axial bore terminating at its forward end in a tapered bore portion, a plurality of chuck jaws defining a frusto conical outer surface adapted to generally matably fit within said tapered bore portion of said collet and each having an inner surface with a plurality of teeth thereon adapted to grip others of the grooves of the pin member, a tubular sleeve member of an elastomeric material slidably disposed in said axial bore, said chuck jaws being individually resiliently fixed secured to a forward end of said tubular sleeve, said tubular sleeve and said chuck jaws being free to axially float within said collet bore from a first position in which said jaws are engaged with said tapered bore portion and are radially closed thereby and a second position in which said jaws are in a radially open condition, said jaws as secured to said tubular sleeve normally being held in said open condition, the length of said axial float being approximately the axial distance between adjacent ones of the others of the grooves of the pin member, said teeth of said jaws having a shape complementary to that of the grooves and crests of the pin member, said jaws in said open condition having said teeth define a minimum diameter opening which is less than the diameter of the crests and greater than that of the grooves whereby the loads required to insert the pin member into said jaws is minimized while providing sufficient interference to preclude said jaws from slipping off the pin member upon relative movement between said collet and said jaws, said minimum diameter being approximately the mean diameter between that of the others of the grooves and their associated crests.

13. A fastening system comprising apparatus for applying a fastener which includes a pin member having a head and a shank and a plurality of grooves and associated crests therein and a tubular member adapted to be located over the shank of the pin member and swaged into some of said grooves, at least a predetermined number of said plurality grooves and crests being substantially identical annular combination locking and breakneck grooves defined by cooperating side walls which converge into a selected concave radius portion, said concave radius portion being of a magnitude selected to provide a predetermined stress concentration to facilitate fracture at a selected one of said grooves proximate the outer end of said tubular member, said apparatus comprising a generally tubularly shaped anvil member having a swaging aperture through a forward portion thereof for swaging the tubular member to the pin member, a generally tubular collet member slidably located within said anvil member and having an axial bore terminating at its forward end in a tapered bore portion, a plurality of chuck jaws defining a frusto conical outer surface adapted to generally matably fit within said tapered bore portion of said collet and each having an inner surface with a plurality of teeth thereon adapted to grip others of said plurality of grooves of the pin member, a tubular sleeve member slidably disposed in said axial bore including elastomeric means for resiliently fixedly securing said chuck jaws to a forward end of said tubular sleeve for resilient radial and axial movement between open and closed positions.

14. Apparatus for setting a fastener comprising a pin member having a head and a shank and a plurality of grooves therein and a tubular member adapted to be located over the shank of the pin member and cooperating with the pin member to secure a plurality of workpieces together upon the application of a relative axial force between the pin member and the tubular member, characterized by the fact that said apparatus comprises a generally tubularly shaped anvil member having an aperture extending through a forward portion thereof for applying the relative axial force between the tubular member and the pin member, a generally tubular collet member slidably located within said anvil member and having an axial bore terminating at its forward end in a tapered bore portion, a plurality of chuck jaws defining a frusto conical outer surface adapted to generally matably fit within said tapered bore portion of said collet and each having an inner surface with a plurality of teeth thereon adapted to grip at least some of the grooves of the pin member, a tubular sleeve member slidably disposed in said axial bore, said chuck jaws being resiliently fixedly secured to a forward end of said tubular sleeve, said tubular sleeve and said chuck jaws being free to move axially within said axial bore from a first position in which said jaws are engaged with said tapered bore portion and are radially closed thereby and a second position in which said jaws are in a radially open condition, said jaws as secured to said tubular sleeve normally being held in said open condition.

15. The apparatus of claim 14 wherein said tubular sleeve is generally substantially coextensive with said axial bore.

16. The apparatus of claim 14 wherein said tubular sleeve and said chuck jaws are free to float in an axial direction a distance approximately equal to the axial distance between adjacent ones of said some of the grooves of the pin member.

17. The apparatus of claim 14 further including elastomeric means resiliently securing said chuck jaws to said forward end of said tubular sleeve.

18. The apparatus of claim 14 wherein said tubular sleeve is fabricated from an elastomeric material.

* * * * *

UNITED STATES PATENT AND TRADEMARK OFFICE

CERTIFICATE OF CORRECTION

PATENT NO. : 4,347,728

DATED : September 7, 1982

INVENTOR(S) : Walter J. Smith

It is certified that error appears in the above—identified patent and that said Letters Patent is hereby corrected as shown below:

Column 5, line 50, "fixed" should be --fixedly--.

Column 6, line 13, "fixed" should be --fixedly--.

Column 7, line 30, after "individually" insert --resiliently fixedly--.

Column 7, line 58, "fixed" should be --fixedly--.

Signed and Sealed this

*Twenty-fourth* Day of *May 1983*

[SEAL]

*Attest:*

DONALD J. QUIGG

*Attesting Officer*

*Acting Commissioner of Patents and Trademarks*